US005094441A

United States Patent [19]

Sebileau

[11] Patent Number: 5,094,441

[45] Date of Patent: Mar. 10, 1992

[54] DEVICE TO TURN OVER SHEETS OF PAPER ONE BY ONE AS THEY COME OUT OF AN AUTOMATIC PAGE-OUTPUT SLOT

[76] Inventor: Vincent M. Sebileau, 4th Avenue de Triel, 78540 Vernouillet, France

[21] Appl. No.: 477,859

[22] PCT Filed: May 31, 1989

[86] PCT No.: PCT/FR89/00264

§ 371 Date: Mar. 30, 1990

§ 102(e) Date: Mar. 30, 1990

[87] PCT Pub. No.: WO89/12015

PCT Pub. Date: Dec. 14, 1989

[51] Int. Cl.[5] ..... B65H 29/00

[52] U.S. Cl. ..... 271/186; 271/207; 414/770; 211/50

[58] Field of Search ..... 271/186, 185, 184, 225, 271/220, 207; 414/770; 211/13, 50

[56] References Cited

U.S. PATENT DOCUMENTS

| | | | |
|---|---|---|---|
| 2,363,490 | 11/1944 | Avery | 271/186 X |
| 3,904,192 | 9/1975 | Pfeifer et al. | 271/186 |
| 4,220,323 | 9/1980 | Smith | 271/186 X |
| 4,671,503 | 6/1987 | Uemori | 271/186 X |

OTHER PUBLICATIONS

Jenkins, Sheet Flip Enhancer, 12-80, pp. 2635-2636, IBM Technical Disclosure Bulletin vol. 23 No. 7A.

*Primary Examiner*—H. Grant Skaggs
*Assistant Examiner*—Carol Lynn Druzbick

[57] ABSTRACT

The invention relates to an oscillating device to be mounted at an automatic sheet output in order to turn over sheets one by one. The device includes a wire designed with two mounting end tabs pivoting on the output, two approximately "S"-shaped lateral sections and an approximately "U"-shaped medial section wherein the extremities of the "U"-shaped section are connected to the respective extremities of the lower loops of the "S"-shaped sections.

6 Claims, 3 Drawing Sheets

FIG. 1
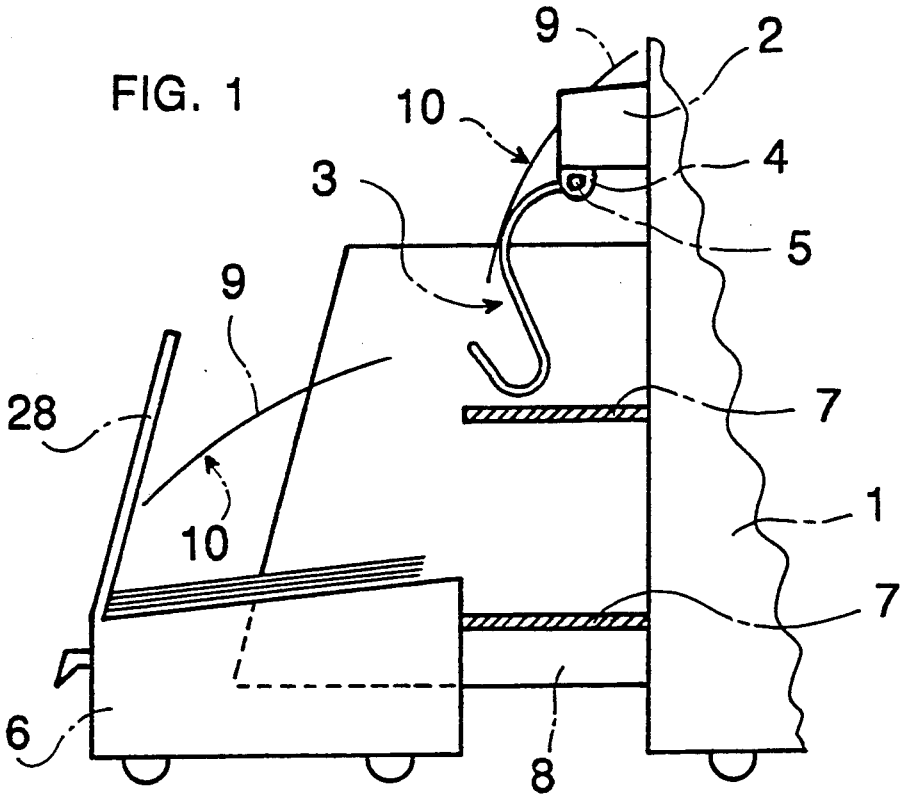
FIG. 2-A
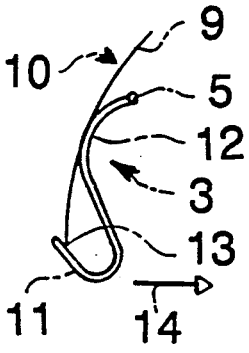
FIG. 2-B
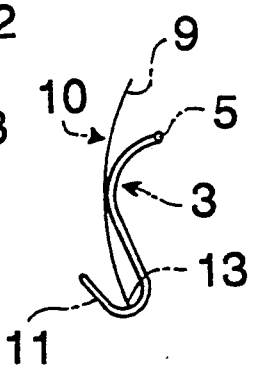
FIG. 2-C
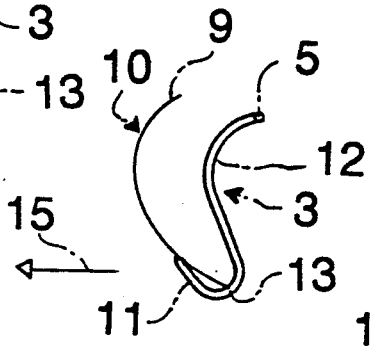
FIG. 2-D
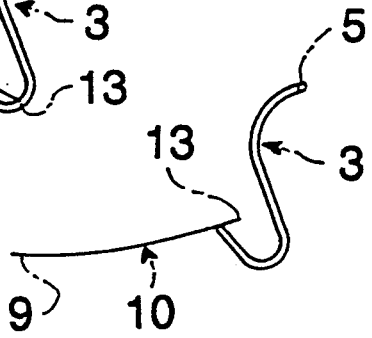

DEVICE TO TURN OVER SHEETS OF PAPER ONE BY ONE AS THEY COME OUT OF AN AUTOMATIC PAGE-OUTPUT SLOT

The present invention concerns a device to turn over sheets of paper one by one as they issue from an automatic page-output slot, in particular, the output slot of a page-at-a-time printer connected to a computer, for example, a laser printer.

Most present-day word-processing software packages with which micro-computers are equipped do not permit printing a document starting with the last page. Furthermore, at the printer's output slot, the printed sheet of paper comes out with the printed side on top. Therefore, after printing a text of several pages, one must sort the pile of pages when the printing has finished in order to put the pages in the right order.

Therefore, manufacturers have sought ways to turn over pages as they issue from the printer before being piled, so that they will be piled with the unprinted side upward. Then all that is necessary to obtain a text in the right order is to turn over the whole pile of pages.

One solution, adopted in particular by a manufacturer of laser printers using the trade name AGFA, consists of making a paper-reception bin at the output slot. The bin has three panels facing the slot. The first is vertical, the second forms an obtuse angle with the vertical panel, and the third forms an obtuse angle with said second panel. The bin is placed under the printer's output slot so that the edge of each sheet of paper coming out of the printer is stopped by the second (inclined) panel. Then the sheet pivots until its printed side leans against the vertical panel. Then the sheet slides onto the third (inclined) panel which serves as a platform for the pile of paper.

Such a system has the inconveniences of being not very reliable, not being adaptable to various types of paper and printers, and of restricting the paper-reception capacity of the printer-output bin.

Thus the present invention is a device to turn over pages below a printer's output slot, a device that is independent of the reception bin or the printer's page-output slot, that is adaptable to various types of paper and/or printers, and that is less costly.

The main characteristic of the present invention is that the device swings back and forth. It is attached under the automatic page-output slot to assure that the pages are turned over one at a time. This device is characterized by consisting essentially of wire, preferably of metal, bent to have two "arms" swinging in the same plane under said output slot, of two side sections in the approximate shape of an "S", and a mid-section with the approximate shape of a "U". The ends of the "U"-shaped section are linked to the respective ends of the lower bend of each "S"-shaped section.

Using metal wire shaped to guide and turn over each page reduces the cost of such a device greatly, and takes advantage of the device's lightness to help the page to turn over with a swinging movement. It also enables limiting friction between the page and the device because of the very slight contact surface.

One particularly advantageous variety of the device included in this invention is a counterweight to adjust how much the device is inclined from the vertical, and a means to adjust the distance (spread) between the ends of each "S"-shaped section; said means consists of a "V"-shaped section between the two bends of each "S"-shaped section. One side of the "V"-shaped section has catches to hold a spread-adjustment ring in a determined position.

Thus a device for turning over sheets of paper is obtained that is particularly simple to manufacture and that can be adapted to various types of papers and/or printer.

We shall now describe in greater detail a particular variety of the invention that will better explain the essential characteristics and the advantages. It should be understood, however, that this variety has been selected as an example and that the invention is by no means limited to this. Its description is illustrated by the appended drawings, in which:

FIG. 1 shows a side view of the part of a printer including the output slot for printed sheets, equipped with a device according to this invention and with a page-reception bin;

FIG. 2 shows a diagram of four stages in the turnover of a page by the device according to this invention;

Figure 3:
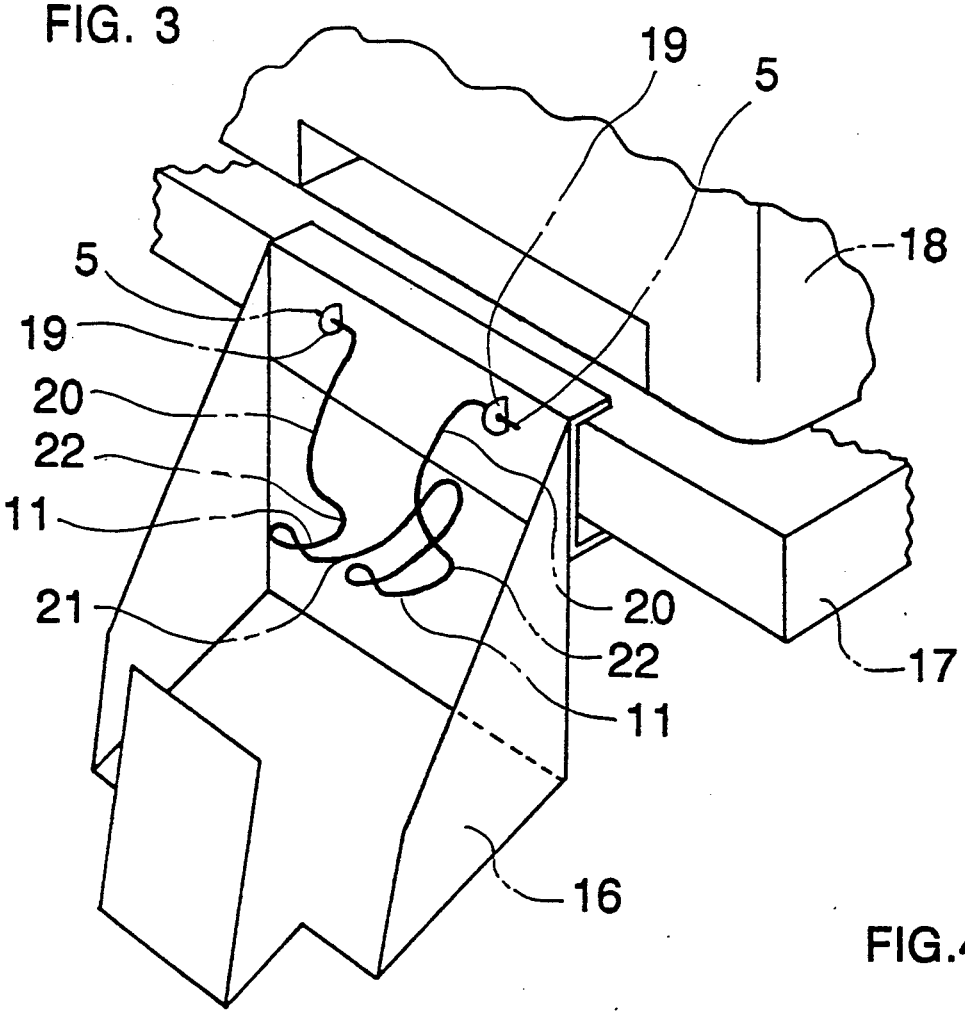
FIG. 3 is a perspective drawing of a variety of the device according to this invention including a page-reception bin.

FIG. 1 is a side view showing part of the back (1) of printer with the trade name AGFA model P 400. It has a conveyor belt (2) to carry the pages out of the printer. A turnover device (3) according to this invention consisting of metal wire is held under the conveyor belt (2) by two rings (4) in which the two ends (5) of the turnover device (3) are inserted. The metal wire has at the side a section in the shape of an "S", roughly. A bin (6) to receive the sheets is placed at a distance from the printer (1) determined by the length of the parts (7) that hold at a proper distance the flanking panels (8) shielding the page output. Since this bin (6) does not serve in the page-turnover process, its capacity can be greater.

The operation of the turnover device (3) will be explained with the help of FIG. 2, and its shape will be better understood after studying FIG. 3.

A sheet (9) issuing from the printer (1) (FIG. 1) slides toward the device (3) with the printed side (10) upward. The lower edge (13) of the sheet (9) trips against the inside of the lower bend (11) of the "S"-shaped section, while the sheet slides down the outside of the upper bend (12) of the "S"-shaped section (FIG. 2-A).

The sheet's edge (13) continues to slide toward the bottom of the bend 11 (FIG. 2-B), pushing the swinging part (3) slightly toward the printer (arrow 14), since the ends (5) of the wire pivot in the rings (4) (FIG. 1). The sheet (9) is then practically vertical, and curves in the same direction as the upper bend (12) of the "S"-shaped section (FIG. 2-C) until the sheet tips over and outward because its lower edge (13) has been stopped by the bottom of the lower bend (11) of the "S"-shaped section and because the device (3) swings back outward (arrow 15) under the impulsion from the sheet (9) after it pushed inward against the bottom of the bend (FIG. 2-A).

The paper sheet (9) then tips and is ejected from the device (3), being almost horizontal, and having its printed side downward (FIG. 2-D). The sheet (9) then fails into the receiving bin (6) (FIG. 1). The latter has an inclined panel (38) to assure proper placement of the sheet (9) in the bin.

FIG. 3 shows a variety of the invented device in which the device (3) consisting of metal wire is hanging from a movable sheet-reception bin (16) allowing placement of the sheet-turnover device beneath the page-output slot of any printer, by fastening the bin (16) to the support (17) of the printer (18). This support can consist of an ordinary table, for instance. The device (3) is held in the same way as previously, that is by two rings (19) in the bin (16). The two ends (5) of the metal wire stick through the rings.

The metal wire is bent so that it has two side sections with "S" shapes (20) and a "U"-shaped mid-section (21) stemming from the curve of the lower bend (11) of each "S"-shaped section (20). In the case of varieties of the device shown in FIGS. 3, 4 and 5, the "U" protrudes beyond the back (22) of the bend (11) of the "S"- shaped sections (20), whereas in the case of the variety shown in FIGS. 1 and 2, the "U" goes no farther back than the back (22) of the bends (11).

This prolongation of the "U" section (21) allows balancing the device (3) by serving as a counterweight to the lower bends (11) of the "S"-shaped section (20).

Figure 4:
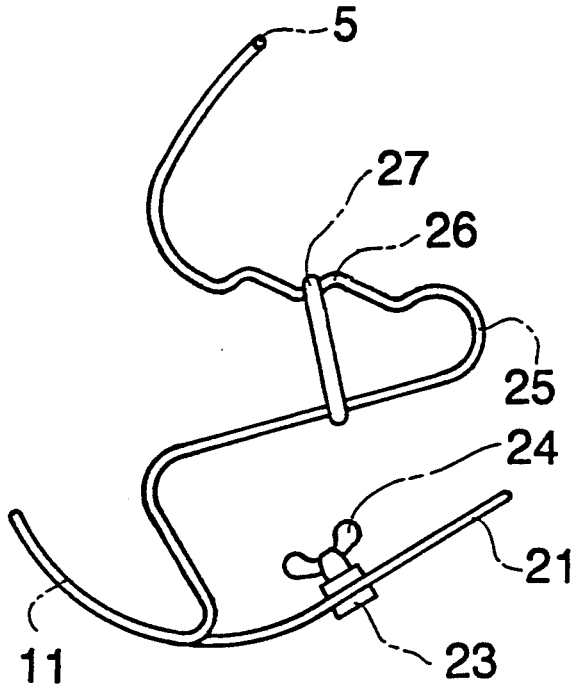
FIG. 4 is a side view of an adjustable variety of the invented device.
Figure 5:
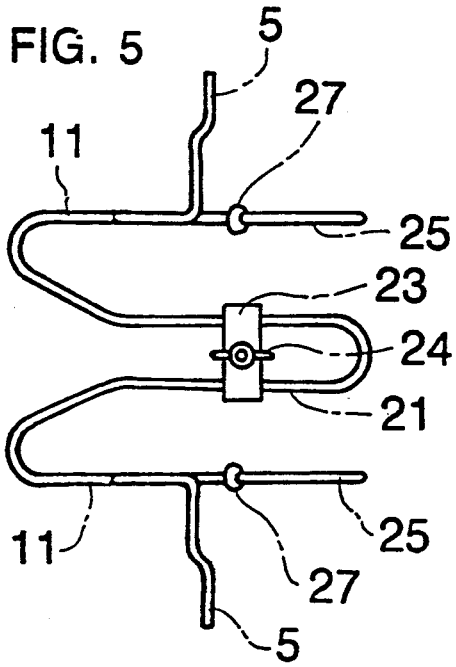
FIG. 5 is a top view of the device shown by FIG. 4.

FIGS. 4 and 5 show another variety of the device that is adjustable to suit the type of paper and/or printer. For that purpose, a small movable weight (23) is added to the "U"-shaped section (21), and is held in the selected position by a screw (24) which squeezes the "U" section (21) like a vice. This little weight (23) allows adjustment of the counter-weight to the lower bends (11) and thus adjusts the device's inclination.

In order to adjust the device for different types of paper according to their weight and/or the size, the "S"-shaped sections (20) were modified to have an extra bend in the shape of a "V" (25) between the two "S"-shaped sections. This bend (25) has catches (26) on one of its sides, and a ring (27) goes around both sides of the "V" (25) and is held by said catches (26).

Thus the spread between bends 11 and 12 can be altered to adjust the device for different types of paper and/or printer.

This adjustment of counterweight and spread should be made depending on the type of paper and the type of printer so that the sheet of paper cannot overshoot the front of the device, which would be the case if it were inclined too much toward the printer, and so that the device can eject the sheet when it has turned over, which would not be the case if the device were inclined too much toward the reception bin.

Figure 6:
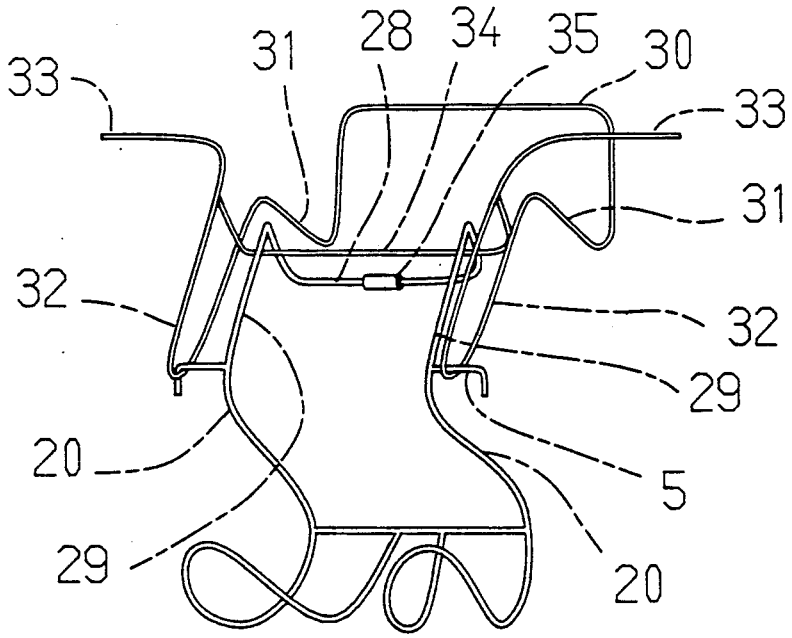
FIG. 6 is a perspective drawing of a variety of the invented device including an upper bend, shown at rest mounted on a supporting device.

FIG. 6 shows a variety of the device illustrating this invention mounted on a supporting device. In this instance, the invented device is equipped with an upper band (28) consisting of a wire, preferably of metal. This bend consists of a "U"-shaped section with a "V"-shaped section at each end (29) in perpendicular planes. Each end (29) is brazed onto the upper part of the "S"-shaped sections (20). The elasticity of the invented device equipped with the upper bend (28) permits momentary bending in order to mount it on the supporting device. Said bend acts as a counterweight for balance. It brings the device's centre of gravity close to is pivoting axis, making it highly sensitive. Said bend determines the invented device's resting position and its amount of maximum swing. The way to adjust said positions is to deform bend (28) permanently by bending it upward or downward. The device is balanced during its manufacture. It can be advantageous to modify the balance by adding a counterweight (35) on the upper bend (28).

The supporting device consists of a wire, preferably of metal, shaped so that it has a "U"-shaped section (30). Each end of this section is prolonged symmetrically by an "S"-shaped section (31) followed by a "U"-shaped section (32), then by an "L"-shaped section (33). The "U" sections (32) act as bearings for the ends (5) of the invented device.

A "U"-shaped connecting bar (34) symmetrically links the two branches of each section 32 and then connects the two sections 32.

Said bar acts as a reinforcement and a stop that checks the invented device when it reaches its resting position.

Figure 7:
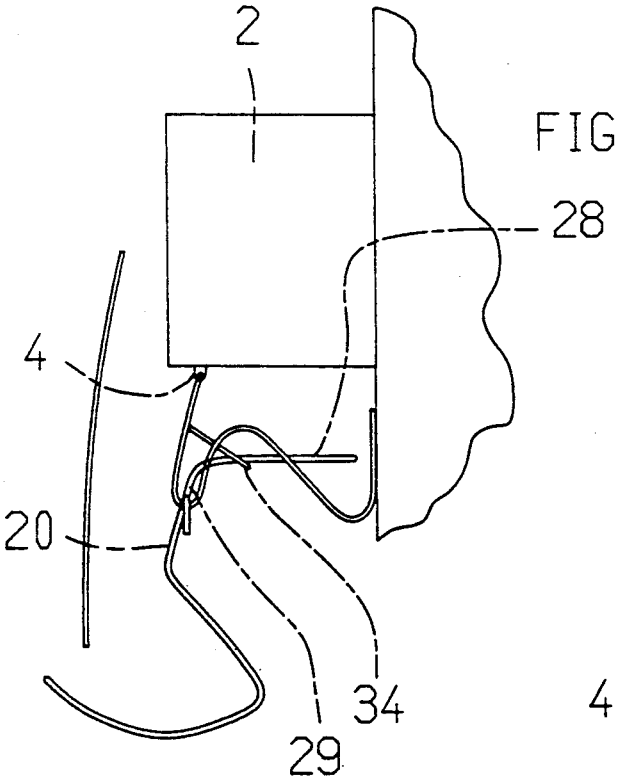
FIGS. 7 and 8 are side views of the part of a printer including a protruding output slot for printed sheets equipped with a support holding the invented device. It is shown in resting position (FIG. 7) and at the end of a swing (FIG. 8).
Figure 8:
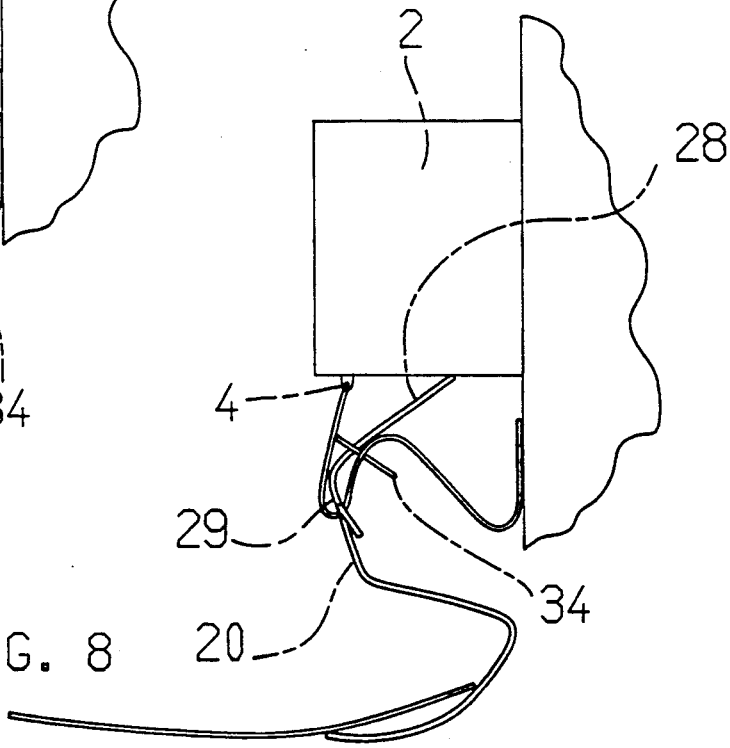

The ends of the section 33 are inserted in the bearings (4) under the sheet-output slot (2) and section 30 rests against the printer's vertical wall and is supported by it (FIGS. 7 and 8).

FIGS. 7 and 8 show the invented device fastened on the printer known by the trade name of AGFA P 400.

That attachment is made by means of a device consisting of a metal wire mounted in fixed position under the paper output, and which supports the invented device.

FIG. 7 shows the invented device in resting position ready to receive a sheet from the paper-output box. The invented device is balanced so that in this position, upper bend 28 rests on connecting bar 34 of the support device, which acts as a stop.

FIG. 8 shows the invented device in page-ejecting position. Indeed, the sheet's weight makes the turnover device leave its resting position to regain balance, and it swings backward in a circular arc until its upper bend (28) strikes a stop. In this case, the upper stop is the printer's paper-output box (2).

Naturally, the invention is by no means limited to the particularities that have been specified in the foregoing explanation, or by the details of the particular varieties selected to illustrate the invention. All sorts of variations can be made in the particular devices described here as examples and in the parts composing them without leaving the invention's framework of principles. It includes all the means constituting technical equivalents of the means described here and all of their combinations.

I claim:

1. An oscillating sheet turnover device mountable under a machine output for assuring that sheets turnover one by one, comprising a wire having two "arms" (5) pivotably mounting the wire to swing under said machine output, two side sections (20) generally in a shape of an "S", each of said side sections (20) having an upper bend section connected at one end to one of said respective arms (5), a lower section extendable outwardly from said machine output and a "U"-shaped midsection linked to respective lower bend of the "S"-shaped section, whereby a leading edge of said output sheet will engage said lower bend section as said sheet is fed from the output, said lower bend section supporting said leading edge of the sheet while the sheet is guided by said upper bend section until such time when the sheet falls from the wire with upper and lower surfaces thereby having been inverted.

2. The device of claim 1 further comprising a counter-weigh adjustable mounted on said "U"-shaped mid-section (21) whereby the wire's inclination about its pivot arms can be adjusted.

3. The device as set forth in claims 1 or 2 wherein the upper bend section includes a means to adjust the distance between the distal ends of each upper and lower bend section of said respective "S"-shaped side sections, said means comprising a "V"-shaped section forming a lower portion of said upper bend section wherein one of two branches of said "V"-shaped section has a series of catches (26) and a ring (27) slidably adjustable about the two branches whereby the upper and lower bend sections can be drawn closer together as the ring is moved upwardly from the base of the "V".

4. The device of claim 1 wherein the wire further comprises a counterweight upper bend section (28, 29) with two lower ends each connected to and above one of said respective pivot arms (5), whereby the wire's center of gravity remains under and close to the pivot arms (5).

5. The device of claims 4 wherein the counterweight upper bend section (28, 29) is adapted to cooperate with first and second abutment means, so as to maintain the wire movable about its pivot arms (5) between a resting position (FIG. 7) where the counterweight upper bend section is abutting said first abutment means (34) and a maximum sing position (FIG. 8) where said counterweight upper bend section is abutting said second abutment means.

6. The device of claim 5 wherein the counterweight upper bend section (28, 29) comprises two "V"-shaped side sections (29) each connected at a first end to one of said pivot arms (5) and a transverse section (28) with two ends respectively connected to a second end of one of said "V"-shaped side sections (29), said first abutment means being a fixed transverse member (34) disposed between two branched of the "V"-shaped side sections (29).

* * * * *